US009782620B2

(12) United States Patent
Morales et al.

(10) Patent No.: US 9,782,620 B2
(45) Date of Patent: Oct. 10, 2017

(54) BARBELL

(71) Applicants: Victor A. Morales, Pomona, CA (US); Esteban R. Morales, Atascadero, CA (US)

(72) Inventors: Victor A. Morales, Pomona, CA (US); Esteban R. Morales, Atascadero, CA (US)

( * ) Notice: Subject to any disclaimer, the term of this patent is extended or adjusted under 35 U.S.C. 154(b) by 0 days.

(21) Appl. No.: 15/078,653

(22) Filed: Mar. 23, 2016

(65) Prior Publication Data

US 2016/0279461 A1 Sep. 29, 2016

Related U.S. Application Data

(60) Provisional application No. 62/139,567, filed on Mar. 27, 2015.

(51) Int. Cl.
*A63B 21/00* (2006.01)
*A63B 21/02* (2006.01)
(Continued)

(52) U.S. Cl.
CPC ..... *A63B 21/0724* (2013.01); *A63B 21/023* (2013.01); *A63B 21/0428* (2013.01); *A63B 21/4035* (2015.10)

(58) Field of Classification Search
CPC ..... A63B 21/0004; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/008; A63B 21/0083; A63B 21/02; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455;
(Continued)

(56) References Cited

U.S. PATENT DOCUMENTS 1,714,391 A * 5/1929 McWhirter ..... A63B 21/015 482/148
1,779,594 A * 10/1930 Hall ..... A63B 21/0728 482/107

(Continued)

*Primary Examiner* — Loan H Thanh
*Assistant Examiner* — Gary D Urbiel Goldner
(74) *Attorney, Agent, or Firm* — Loza & Loza, LLP; Heidi L. Eisenhut

(57) ABSTRACT

An improved barbell having horizontal spring-loaded resistance for increased muscular activity in an individual is provided. Spring action created by the horizontal spring-loaded resistance in the improved barbell provides the individual with additional muscle activation as compared to a traditional barbell. The improved barbell may include a spring that can be compressed and uncompressed using a tubular steel shaft, which is maintained in place by a self-lubricating linear bearing to reduce binding. The design provides a smooth action consistent with muscle-building execution exercises. The spring and bearing may be encased in a barrel with precision. The barrel may be welded to a 1-inch diameter steel tubular shaft. A separate 1-inch diameter steel tubular shaft may be installed in the barrel. The pair of tubular shafts may hold a desired weight.

16 Claims, 5 Drawing Sheets

(51) Int. Cl.
*A63B 21/04* (2006.01)
*A63B 21/072* (2006.01)

(58) Field of Classification Search
CPC ... A63B 21/05; A63B 21/055; A63B 21/0552; A63B 21/0555; A63B 21/0557; A63B 21/06; A63B 21/0618; A63B 21/072; A63B 21/0724; A63B 21/15; A63B 21/159; A63B 21/4023; A63B 21/4033; A63B 21/4035; A63B 21/4043; A63B 21/4045; A63B 23/035; A63B 23/03516; A63B 23/03533; A63B 23/03541; A63B 23/12; A63B 23/1209; A63B 23/1245; A63B 23/1281; A63B 71/0054; A63B 2071/0063; A63B 2071/0072; A63B 2071/0081; A63B 2071/009; A63B 2225/09
See application file for complete search history.

(56) References Cited

U.S. PATENT DOCUMENTS 1,956,498 A * 4/1934 Duke ..... A63B 21/015 482/116
2,470,816 A * 5/1949 Harvey ..... A63B 15/00 482/108
2,528,213 A * 10/1950 Dantolan ..... A63B 21/072 482/131
3,118,668 A * 1/1964 Callahan ..... A63B 21/078 211/182
3,231,270 A * 1/1966 Winer ..... A63B 21/0602 482/106
3,343,837 A * 9/1967 Grzybowski ..... A63B 21/0004 482/126
3,384,370 A * 5/1968 Bailey ..... A63B 21/0724 482/106
3,471,145 A * 10/1969 Berger ..... A63B 21/00072 482/112
3,756,597 A * 9/1973 Monti ..... A63B 21/0004 273/DIG. 6
3,761,083 A * 9/1973 Buchner ..... A63B 21/05 482/126
3,834,696 A * 9/1974 Spector ..... A63B 21/0004 482/112
3,904,198 A * 9/1975 Jones ..... A63B 21/0724 482/106
3,938,803 A * 2/1976 Wilmoth ..... A63B 21/05 482/127
3,971,255 A * 7/1976 Varney ..... A61B 5/224 482/114
4,351,527 A * 9/1982 Crisp, Jr. ..... A63B 21/00043 482/121
4,461,473 A * 7/1984 Cole ..... A63B 21/0004 482/106
4,471,956 A * 9/1984 Marlo ..... A63B 21/4029 482/104
4,518,162 A * 5/1985 Oates ..... A63B 21/072 403/349
4,585,229 A * 4/1986 Brasher ..... A63B 21/0724 482/106
4,618,142 A * 10/1986 Joseph, Jr. ..... A63B 5/20 482/106
4,623,146 A * 11/1986 Jackson ..... A63B 21/05 482/106
4,690,400 A * 9/1987 Metz ..... A63B 21/015 482/106
4,695,049 A * 9/1987 Ciemiega ..... A63B 23/14 482/115
4,743,018 A * 5/1988 Eckler ..... A63B 21/0724 482/106
4,749,188 A * 6/1988 Montgomery ..... A63B 21/0602 482/106
4,775,149 A * 10/1988 Wilson ..... A63B 21/022 482/126
4,943,052 A * 7/1990 Powers ..... A63B 21/0724 482/106
4,951,941 A * 8/1990 Resk ..... A63B 21/0004 482/112
4,978,122 A * 12/1990 Dibowski ..... A63B 21/0724 482/106
5,024,434 A * 6/1991 Smith ..... A63B 21/0724 482/106
5,152,731 A * 10/1992 Troutman ..... A63B 21/0724 482/106
5,211,616 A * 5/1993 Riley, Jr. ..... A63B 21/072 482/106
5,257,964 A * 11/1993 Petters ..... A63B 21/0724 403/377
5,300,002 A * 4/1994 Freye ..... A63B 23/12 482/114
5,334,118 A * 8/1994 Dantolan ..... A63B 15/005 482/109
5,496,244 A * 3/1996 Caruthers ..... A63B 21/0605 482/108
5,509,879 A * 4/1996 Lanzagorta ..... A63B 21/015 482/115
5,536,227 A * 7/1996 Polchek ..... A63B 21/0728 482/106
5,620,402 A * 4/1997 Simonson ..... A63B 23/1254 482/100
5,643,160 A * 7/1997 Huang ..... A63B 21/00185 482/122
5,697,873 A * 12/1997 Van Straaten ..... A63B 21/0004 482/122
5,788,617 A * 8/1998 Paris ..... A63B 21/00043 482/112
5,820,531 A * 10/1998 Choi ..... A63B 21/072 482/110
5,836,858 A * 11/1998 Sharff ..... A63B 21/0724 482/104
5,891,004 A * 4/1999 Berry ..... A63B 21/04 482/106
6,022,300 A * 2/2000 Hightower ..... A63B 21/0724 482/106
6,186,930 B1 * 2/2001 Ignaczak ..... A63B 23/12 482/141
6,196,953 B1 * 3/2001 Buchanan ..... A63B 21/072 482/114
6,468,190 B1 * 10/2002 Fazio ..... A63B 21/00072 482/111
6,976,942 B2 * 12/2005 Kennedy ..... A63B 21/00043 482/122
7,056,268 B2 * 6/2006 Emick ..... A63B 21/0724 482/106
7,086,999 B2 * 8/2006 Jeneve ..... A63B 21/015 482/106
7,108,643 B2 * 9/2006 Wilson ..... A63B 23/12 482/141
7,163,495 B2 * 1/2007 Fazio ..... A63B 21/0004 482/111
7,393,309 B2 * 7/2008 Webber ..... A63B 21/078 482/104
7,628,741 B2 * 12/2009 Adcock ..... A63B 21/00185 482/122
7,794,377 B2 * 9/2010 Amzallag ..... A63B 21/0724 482/104
7,862,486 B1 * 1/2011 Watson ..... A63B 21/0724 482/106
7,892,158 B2 * 2/2011 Varga ..... A63B 21/4017 482/141
8,047,973 B2 * 11/2011 Berenshteyn ..... A63B 21/0724 482/100
8,162,808 B2 * 4/2012 Cook ..... A63B 21/0083 482/112
8,328,698 B1 * 12/2012 Webber ..... A63B 21/078 482/104
9,005,087 B1 * 4/2015 Betoney, Jr. ..... A63B 21/06 482/104

(56) References Cited

U.S. PATENT DOCUMENTS 9,050,495 B2 * 6/2015 Sieben ..... A63B 71/0036
9,114,279 B2 * 8/2015 Murray ..... A63B 21/0724
9,126,075 B2 * 9/2015 Tomaszewski ..... A63B 21/06
9,522,298 B2 * 12/2016 Siemer ..... A63B 21/4045
2003/0096680 A1 * 5/2003 Nethery ..... A63B 21/0004 482/92
2004/0132590 A1 * 7/2004 Papas ..... A63B 15/00 482/109
2005/0101453 A1 * 5/2005 Jeneve ..... A63B 21/015 482/106
2005/0113219 A1 * 5/2005 Pierre, II ..... A63B 21/00043 482/121
2006/0276314 A1 * 12/2006 Wilson ..... A63B 21/015 482/106
2008/0081747 A1 * 4/2008 Mok ..... A63B 21/0004 482/121
2008/0176723 A1 * 7/2008 Johnson ..... A63B 21/0724 482/106
2008/0261788 A1 * 10/2008 Blount ..... A63B 21/4001 482/139
2009/0197742 A1 * 8/2009 Hartman ..... A63B 21/026 482/50
2010/0075815 A1 * 3/2010 Deppen ..... A63B 21/0728 482/93
2010/0152002 A1 * 6/2010 Knight ..... A63B 21/072 482/93
2010/0190618 A1 * 7/2010 Chen ..... A63B 21/075 482/108
2010/0197470 A1 * 8/2010 Hartman ..... A63B 21/4017 482/139
2010/0222186 A1 * 9/2010 Grand ..... A63B 21/0602 482/107
2010/0227747 A1 * 9/2010 Cook ..... A63B 21/0083 482/112
2011/0177922 A1 * 7/2011 Selinger ..... A63B 21/0724 482/107
2012/0094812 A1 * 4/2012 Smiley ..... A63B 21/0004 482/128
2012/0322630 A1 * 12/2012 Hood ..... A63B 21/023 482/106
2013/0035218 A1 * 2/2013 Wierszewski ..... A63B 21/4035 482/106
2014/0045660 A1 * 2/2014 Murray ..... A63B 21/0724 482/106
2014/0221173 A1 * 8/2014 Crabtree ..... A63B 21/0724 482/106
2014/0323275 A1 * 10/2014 Moses, II ..... A63B 21/1627 482/40
2016/0047405 A1 * 2/2016 Curley ..... F16B 7/10 482/139

* cited by examiner

BARBELL

CLAIM OF PRIORITY UNDER 35 U.S.C. §119

The present application for patent claims priority to U.S. Provisional Application No. 62/139,567 entitled "BARBELL", filed Mar. 27, 2015, and is hereby expressly incorporated by reference herein.

FIELD

The present invention generally relates to barbells, and particularly to barbells utilized for weight and strength training. More specifically, the present invention is directed to a barbell which has a compressible section in the bar for allowing a user to compress and uncompress the bar laterally providing a variation of movements that target upper body muscle groups for sculpting and strength.

BACKGROUND

Optimizing muscle activation of a user during resistance exercise is conducive to overall muscular adaptations to a long-term training program (i.e. muscular growth and strength development). Various techniques and strategies have been implemented in practice to optimize muscle activation during resistance exercise, such as movement and exercise equipment manipulations.

A barbell is a well-known piece of exercise equipment that is used not only in weight training, weightlifting and powerlifting, but also utilized as a key piece of equipment in resistance exercises. However, standard barbells limit users to one movement at a time, targeting one specific area of a muscle. If a user wants to target another area of the same muscle, the barbell and user must be reconfigured, requiring a pause in the exercise and a relaxation of the muscle and thus failing to optimize muscle activation. In view of the foregoing, what is needed is a barbell that can instantaneously transition into different movements, targeting a muscle group without pause, reconfiguration, and relaxation and thereby providing users a more intense exercise and experience.

In view of the above, what is needed is an improved barbell that provides greater muscular activation for a given barbell exercise and that improves the overall quality of training over a typical barbell. More specifically, what is needed is an improved barbell that provides horizontal resistance via a spring mechanism within the handle of the barbell for achieving greater muscle activation improving the overall quality of training.

SUMMARY

One feature provides for an exercise device. The exercise device comprises a first elongated cylindrical tubular shaft having a first end and a second end; a second elongated cylindrical tubular shaft having a first end and a second end; a first grip member fixedly attached to the first elongated cylindrical tubular shaft; and a barrel assembly slideably mounted on the second end of the first elongated cylindrical tubular shaft at the second end of the second elongated cylindrical tubular shaft. The barrel assembly of the exercise device comprises an elongated tubular housing having a first housing end and a second housing end; a hollow tubular sleeve mounted on the elongated tubular housing on the second housing end; a single stroke stop installed at the second end of the first elongated cylindrical tubular shaft; and an elongated compression spring longitudinally disposed about the elongated tubular housing after the single stroke stop and adapted to be compressed and expanded along a determined direction. The exercise device further comprises a second grip member is fixedly attached to the second elongated cylindrical tubular shaft, the first and second grip members disposed equidistant from a center region when in an uncompressed position.

According to one aspect, the barrel assembly comprises a self-lubricating linear bearing disposed in the first housing end and retained by an internal retaining ring for maintaining the elongated cylindrical shaft in place and reducing binding. The self-lubricating bearing includes a hollow cylindrical body having an axial hole in its center.

According to another aspect, the barrel assembly further comprises a striker located in an axial hole in the barrel assembly and retained by the self-lubricating linear bearing at the first housing end of the tubular housing.

According to yet another aspect, the first grip member is a dual grip member having a horizontal portion and an angled portion extending upwardly from the horizontal portion.

According to yet another aspect, the second grip member is a dual grip member having a horizontal portion and an angled portion extending upwardly from the horizontal portion.

According to yet another aspect, the first and second elongated cylindrical tubular shafts are made of hardened steel.

According to yet another aspect, decreasing the distance between the first and second grip members compresses the spring creating a resistance providing more pectoral and bicep stimulation of a user.

According to yet another aspect, the exercise device is a barbell.

According to another feature, an exercise device is provided. The exercise device comprises a first elongated cylindrical tubular shaft having a first end and a second end; a second elongated cylindrical tubular shaft having a first end and a second end; a first grip member fixedly attached to the first elongated cylindrical tubular shaft; and a barrel assembly slideably mounted on the second end of the first elongated cylindrical tubular shaft at the second end of the second elongated cylindrical tubular shaft. The barrel assembly of the exercise device comprises an elongated tubular housing having a first housing end and a second housing end; a hollow tubular sleeve mounted on the elongated tubular housing on the second housing end; an elongated compression spring longitudinally disposed about the elongated tubular housing and adapted to be compressed and expanded along a determined direction; and a single stroke stop installed at the second end of the first elongated cylindrical tubular shaft after the elongated compression spring.

The exercise device further comprises a second grip member is fixedly attached to the second elongated cylindrical tubular shaft, the first and second grip members disposed equidistant from a center region when in an unexpanded position.

According to one aspect, the barrel assembly further comprises a self-lubricating linear bearing disposed in the first housing end and retained by an internal retaining ring for maintaining the elongated cylindrical shaft in place and reducing binding.

According to yet another aspect, the self-lubricating bearing includes a hollow cylindrical body having an axial hole in its center.

According to yet another aspect, the barrel assembly further comprises a striker located in an axial hole in the barrel assembly and retained by the self-lubricating linear bearing at the first housing end of the tubular housing.

According to yet another aspect, the first grip member is a dual grip member having a horizontal portion and an angled portion extending upwardly from the horizontal portion.

According to yet another aspect, the second grip member is a dual grip member having a horizontal portion and an angled portion extending upwardly from the horizontal portion.

According to yet another aspect, the first and second elongated cylindrical tubular shafts are made of hardened steel.

According to yet another aspect, increasing the distance between the first and second dual grip members compresses the spring creating a resistance providing more back and deltoid stimulation of a user.

According to yet another aspect, the exercise device is a barbell.

DETAILED DESCRIPTION

Figure 1:
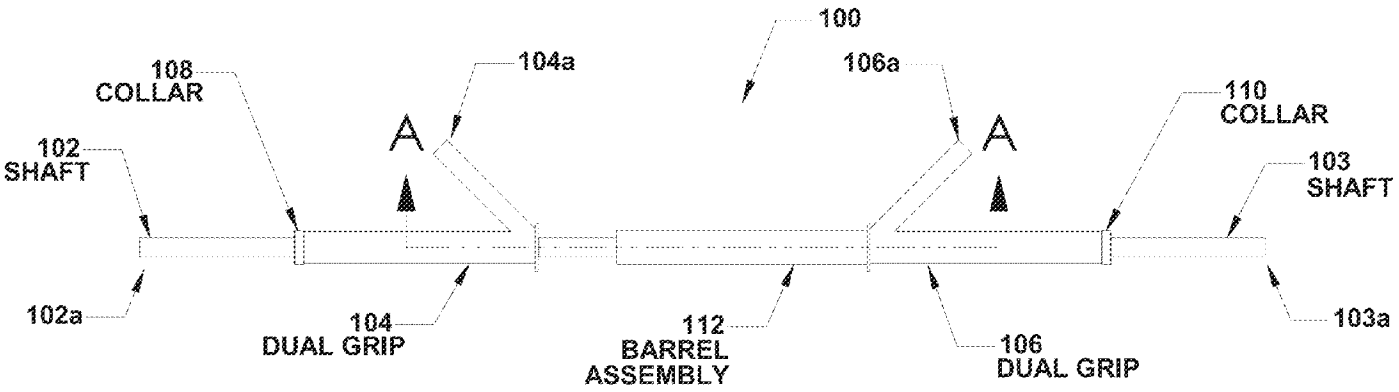
FIG. 1 is an illustration of a barbell exercise device, according to one embodiment.

The following detailed description is of the best currently contemplated modes of carrying out the invention. The description is not to be taken in a limiting sense, but is made merely for the purpose of illustrating the general principles of the invention. Furthermore, in the following description, specific details are given to provide a thorough understanding of the embodiments. However, it will be understood by one of ordinary skill in the art that the embodiments may be practiced without these specific details.

In the following description, the terms "user", "individual" and "subject" may refer to anyone utilizing the improved barbell having horizontal spring-loaded resistance of the present disclosure and may be used interchangeably.

Overview

According to one embodiment, an improved barbell having horizontal spring-loaded resistance allowing a user to compress the barbell inward, when in use, varying resistance is provided. In other words, the improved barbell may be designed to allow a user to compress the barbell inward using hand grips allowing a varying resistance to be created by using spring action. The spring action allows the individual to compress the barbell during the exercise in which the barbell is being used which in turn causes more pectoral and bicep stimulation as compared to a traditional barbell.

When in use, the spring may be forced in and out, i.e. compressed and uncompressed, by a tubular steel shaft, which is maintained in place by a self-lubricating linear bearing to reduce binding. The design provides a smooth action consistent with muscle-building execution exercises. The spring and bearing may be incased in a barrel with precision. The barrel may be welded to a 1-inch diameter steel tubular shaft. A separate 1-inch diameter steel tubular shaft may be installed in the barrel. The pair of tubular shafts may hold the desired weight plates. The plates may be secured with standard clips. Although the steel tubular shafts are described as having a 1-inch diameter, this is by way of example only and steel tubular shafts having a diameter less than 1-inch or greater than 1-inch may be used According to another aspect, the barbell may instantaneously transition into different movements, targeting a muscle group without pause, reconfiguration, and relaxation thereby providing users a more intense exercise, workout and experience. According to yet another aspect, the barbell may provide a variation of movements that target upper body muscle groups for sculpting and strength.

According to yet another aspect, the improved barbell of the present disclosure may replace or augment the standard barbell including, but not limited to the following exercises: chest press, bent-over row, shoulder lift and press, upright row, deltoid lift, barbell shrug, bicep curl and preacher curl.

According to another embodiment, an improved barbell having horizontal spring-loaded resistance allowing a user to extend the barbell outward, when in use, varying resistance is provided. In other words, the improved barbell may be designed to allow the user to extend the barbell outward using hand grips allowing a varying resistance to be created by using spring action. The spring action allows the individual to extend the barbell outward during the exercise in which the barbell is being used which in turn causes more back and deltoid stimulation as compared to a traditional barbell.

Inward Compression Barbell

Figure 2:
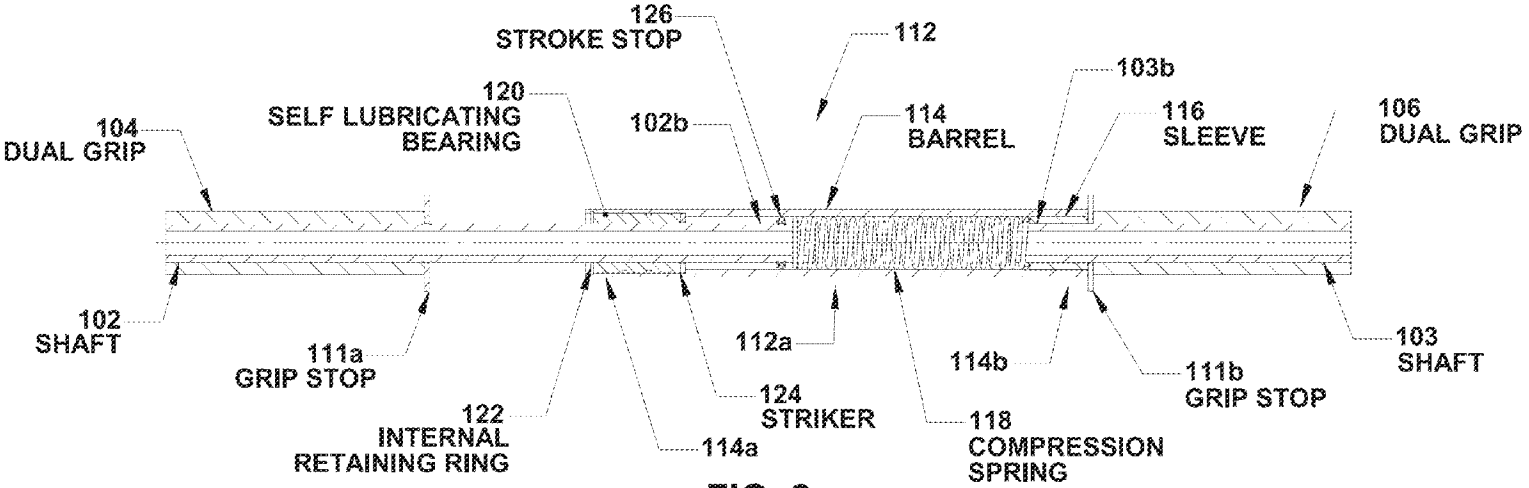
FIG. 2 is a cross-sectional view of the barbell of FIG. 1 taken along line A-A.
Figure 3:
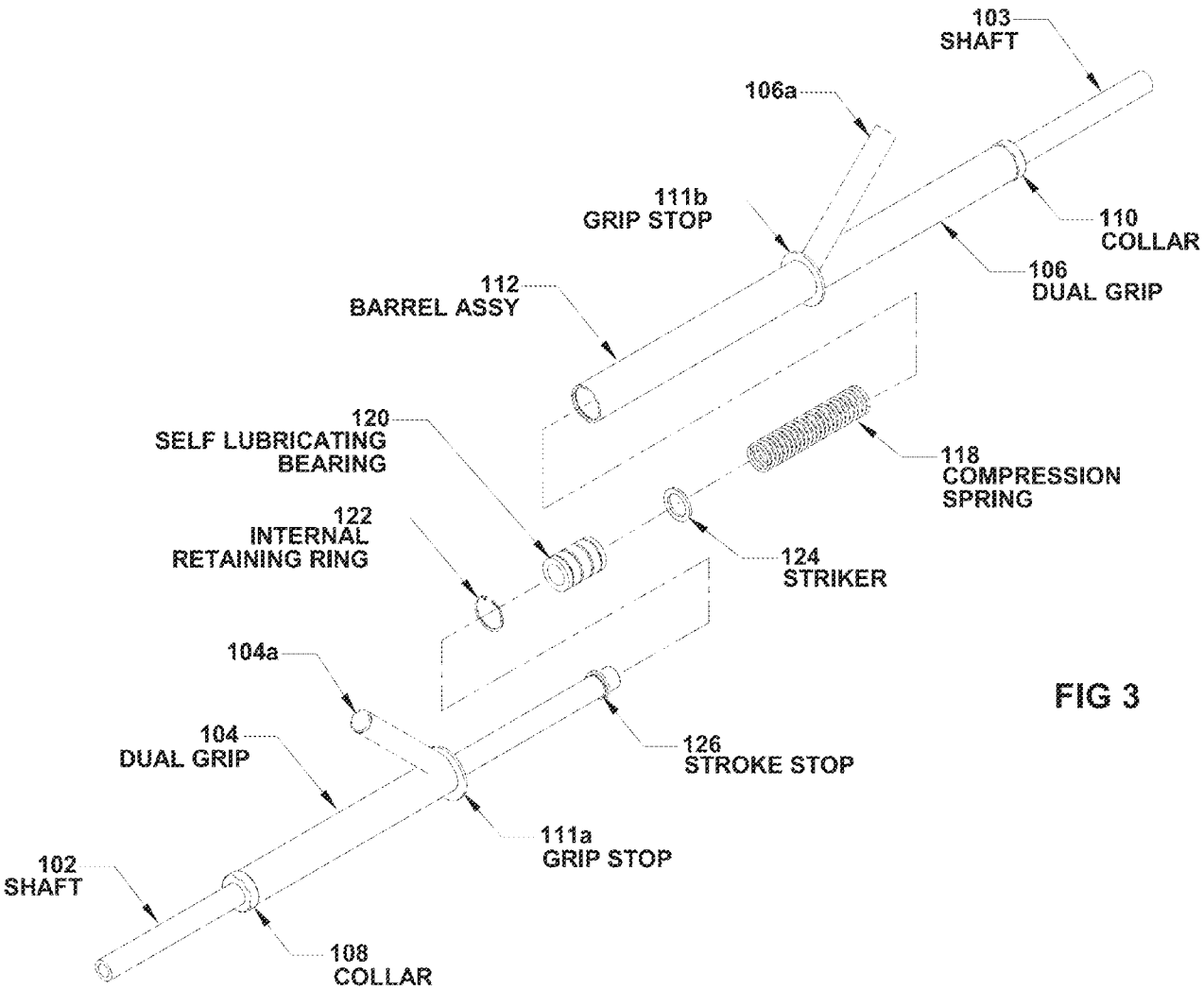
FIG. 3 is an exploded view of the barbell of FIG. 1.

FIG. 1 is an illustration of a barbell, according to one embodiment. FIG. 2 is a cross-sectional view of the barbell of FIG. 1 taken along line A-A. FIG. 3 is an exploded view of the barbell of FIG. 1. The following discussion refers interchangeably to FIGS. 1-3.

The barbell 100 may utilize a spring action to provide resistance so a user can compress the barbell during an exercise resulting in more pectoral and bicep stimulation for the user than the tradition barbell. As shown, the barbell 100 may include a first elongated cylindrical tubular shaft 102, having a first end 102*a* and a second end 102*b*, and a opposing second elongated cylindrical tubular shaft 103 having a first end 103*a* and a second end 103*b*. Tubular shaft ends 102*b* and 103*b* are located in a barrel assembly 112, described in more detail below. A first grip member 104 and a second grip member 106 may be disposed on the first and second elongated cylindrical tubular shafts 102 and 103 respectively equidistant from the center region 112*a* of the barbell. According to one example as shown, the first and second grip members 104, 106 may be dual grip members having an optional angled portion 104*a* and 106*a*, respectively, extending outwardly providing the user with different options in which to place his hands while grasping the barbell.

The first ends 102*a*, 103*a* of the elongated tubular shafts 102 and 103 are adapted to receive weight plates (not shown) of varying weight. The weights may be held in place and secured to the first elongated tubular cylindrical shaft 102 by a first collar 108 and a second collar 110 on the second elongated tubular shaft 103, respectively. The first and second grip members 104, 106 may be adapted for receiving hands of a user allowing the user to lift the exercise device 100 for exercising, including but not limited to weight training, weightlifting and powerlifting. According to one example, a user may utilize the barbell 100 without any weight plates secured thereon.

The barbell 100 may further include a barrel assembly 112 slideably mounted on the first and second elongated tubular cylindrical shafts 102 and 103 located between the first and second grip members 104, 106. The barrel assembly 112 may be adapted to expand and compress the first elongated tubular cylindrical shaft 102 varying resistance applied to the targeted muscle group. Varying the resistance enables the user to instantaneously force the exercise device inward following a standard movement and control its natural reverse action outward. Collectively, these additional movements provide constant tension to a targeted muscle group.

According to one embodiment, the barrel assembly 112 may comprise a tubular housing 114 having a first housing end 114*a* and a second housing end 114*b* and a hollow tubular sleeve 116 axially mounted on the second elongated cylindrical shaft end 103*b*. (See FIG. 2) An elongated compression spring 118 may be longitudinally located in the hollow chamber of the tubular housing 114 and adapted to be compressed and expanded along a determined direction varying the tension and resistance. A self-lubricating bearing 120, which is a hollow cylindrical body with an axial hole in its center, and a striker 124 may be located in a bored hole in the barrel assembly 112 and retained by an internal retaining ring 122 and the first housing end 114*a* of the tubular housing 114 for maintaining the first elongated cylindrical shaft 102 in place and reducing binding.

The barrel assembly 112 may further comprise of a single stroke stop 126 installed at the end 102*b* of the first elongated tubular shaft 102 and located at the end of the compression spring 118 when mechanically assembled. That is, the compression spring 112 is located after the single stroke stop 126.

The barrel assembly 112 may be connected to a grip stop 111*b* of the second grip member 106. The barrel assembly 112 may be moveable between an expanded position and a compressed position. A user may exert an inward force on both grip members 106 and 104 utilizing standard (i.e. horizontal portions) or secondary (i.e. the angled portions) 104*a* and 106*a* grip positions simultaneously to compress the compression spring 118 creating tension. Conversely, a user may use both grip members 106 and 104 simultaneously to resist the expansion of the compression spring 118.

The barbell 100 described herein may provide several variations available to a user not offered in a standard barbell thus expanding its use and value. For example, when utilizing the barbell of the present disclosure (1) the inward tension may be held by a user throughout a standard exercise; (2) the inward force executed by the user may be executed at various points in a standard movement; (3) the inward tension may be forced and released at various momentums and rates; and (4) resistance force can be further modified by alternating plates of different weight in combination with examples 1-3 identified above, as well as with any other known technique that may be utilized with the improved barbell of the present disclosure. As such, the barbell 100 described above, provides a user with a myriad of constant tension-packed movements for upper body muscles that will maintain muscle stimulation and confusion required for strength, sculpting and growth.

Study

The barbell 100 as shown and described in FIGS. 1-3 has been shown in a study, conducted at California State Polytechnic University Pomona, to stimulate the pectoral and bicep muscle group of a human body by up to 1000% more than a standard, traditional barbell. The study was designed to compare the electromyography (EMG), which is an electrodiagnostic medicine technique for evaluating and recording the electrical activity produced by skeletal muscles, with a standard barbell and the improved barbell of the present disclosure. That is, muscle activation during resistance exercises using a standard 20 kg barbell, for example, and the improved barbell 100 of the present disclosure was tested. The tests results using a traditional 20 kg barbell were then compared to test results utilizing the improved barbell 100 having horizontal spring-loaded resistance of the present disclosure.

The study was conducted using six (6) subjects—three (3) untrained subjects and three (3) trained subjects. The subjects visited the test site on two separate occasions separated by a period of 48 hours. During the first visit, each subject underwent body composition and anthropometric measurements. Next, each subject was tested for maximal strength for the bench press, shoulder press, frontal shoulder raise, triceps extension, and bicep curl exercises. A ten (10) repetition maximum test was implemented for the shoulder press, frontal shoulder raise, triceps extension, and bicep curl exercises and a one (1) repetition maximum was extrapolated. These strength measurements were utilized 1) to provide a descriptive measure of the subject pool in terms of training status and 2) to provide a reference for the control exercise conditions during the subsequent visit.

During the second visit of the study, the subjects performed the same five (5) exercises at a load corresponding to 75% of each subject's respective one repetition maximum (1RM) for two (2) sets of five (5) repetitions utilizing the traditional, standard barbell as well as the barbell 100 having horizontal spring-loaded resistance of the present disclosure. The different barbells were implemented in a randomized order and during each set, EMG activity was measured in the pectoralis major, frontal deltoid, medial deltoid, lateral triceps, and medial biceps of the subject. The overall and muscle specific EMG activity was then compared for each exercise between the traditional and the barbell 100 having horizontal spring-loaded resistance of the present disclosure.

Figure 7:
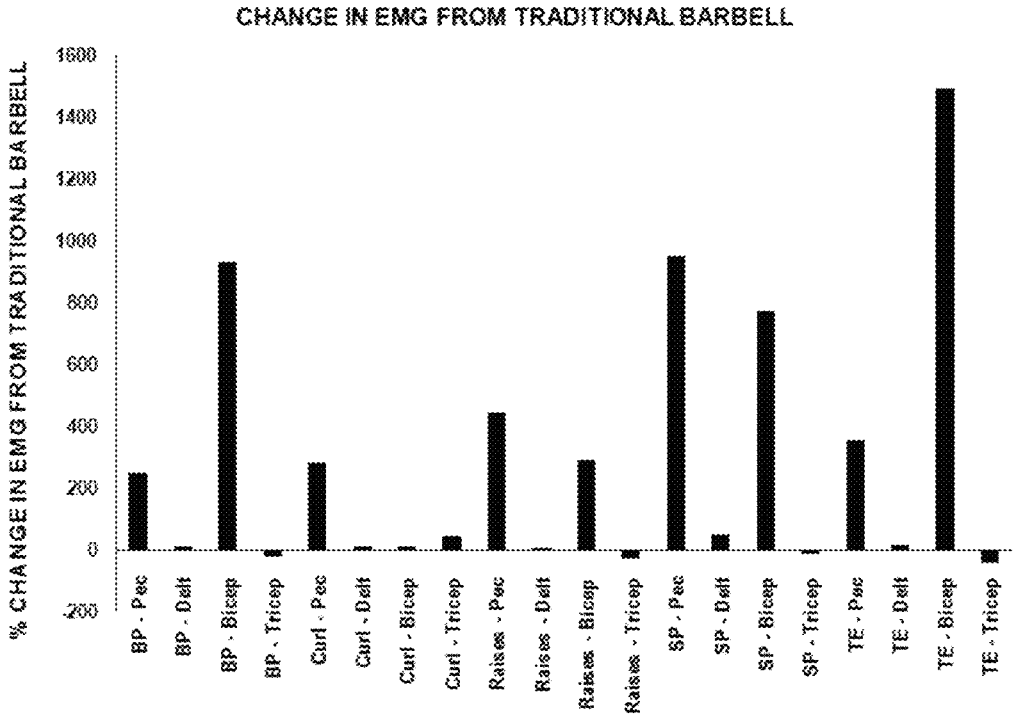
FIG. 7 is a graph illustrating change in EMG from a traditional barbell.

The percent change (values are reported as percentages) in EMG activity when using the barbell 100 having horizontal spring-loaded resistance of the present disclosure is illustrated in the table and graph below. As can be seen in the data in the table and the graph in FIG. 7, the subjects utilizing the barbell 100 having horizontal spring-loaded resistance of the present disclosure had an increased activation for the pectoralis major, deltoids, and biceps for all exercises. However the triceps activity may appear to be slightly diminished when utilizing the barbell 100 having horizontal spring-loaded resistance of the present disclosure compared to the traditional, standard barbell for all exercises except for the biceps curl which is likely due to the transfer of muscle activation towards muscles involved in pushing together the hands against the horizontal resistance during chest, shoulder, and triceps exercises.

| | Pectoralis Major | Deltoid | Biceps | Triceps |
|---|---|---|---|---|
| Bench Press | 248.32 | 8.40 | 927.99 | −23.79 |
| Biceps Curl | 282.23 | 11.15 | 10.66 | 43.76 |
| Shoulder Raise | 445.68 | 0.08 | 291.79 | −25.57 |

-continued

| | Pectoralis Major | Deltoid | Biceps | Triceps |
|---|---|---|---|---|
| Shoulder Press | 947.11 | 48.00 | 774.53 | −9.45 |
| Triceps Extension | 354.47 | 14.37 | 1494.01 | −41.68 |
| Average Change | 455.56 | 16.40 | 699.80 | −11.34 |

Figure 8:
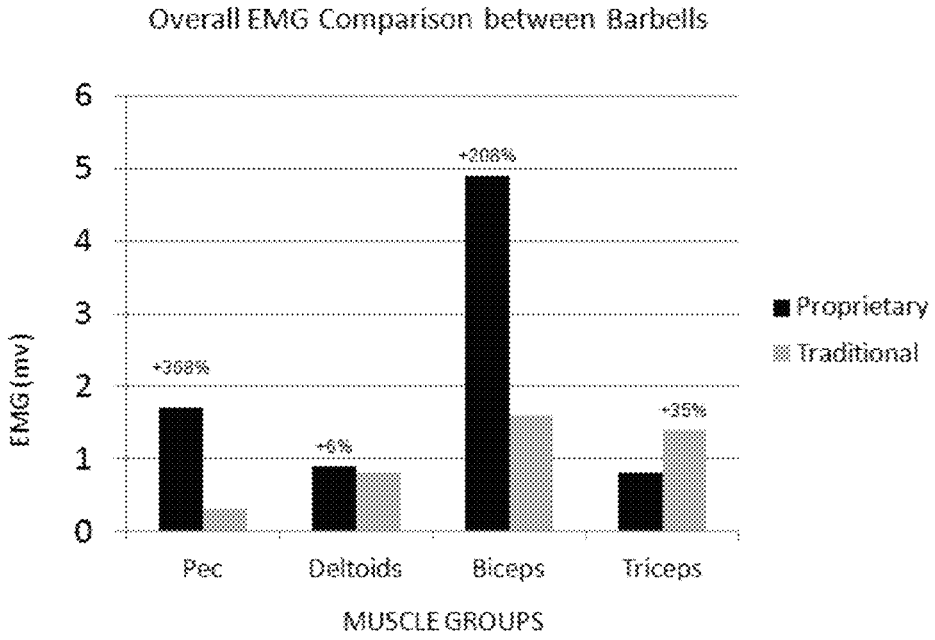
FIG. 8 is a graph illustrating the overall EMG comparison between a typical barbell and the barbell of the present disclosure.

As shown in the graph of FIG. 8, when analyzing overall muscle activation profiles (combining all exercises), there is a 368% increase in pectoralis major activation, 6% increase in deltoid activation and a 208% increase in biceps activation. A slight decrease in triceps activation is shown when utilizing the proprietary barbell system.

Outward Extension Barbell

Figure 4:
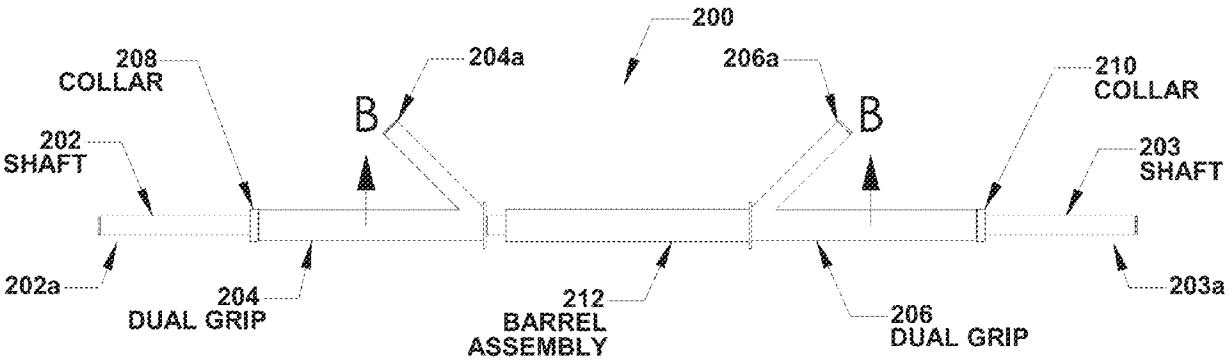
FIG. 4 is an illustration of a barbell, according to one embodiment.
Figure 5:
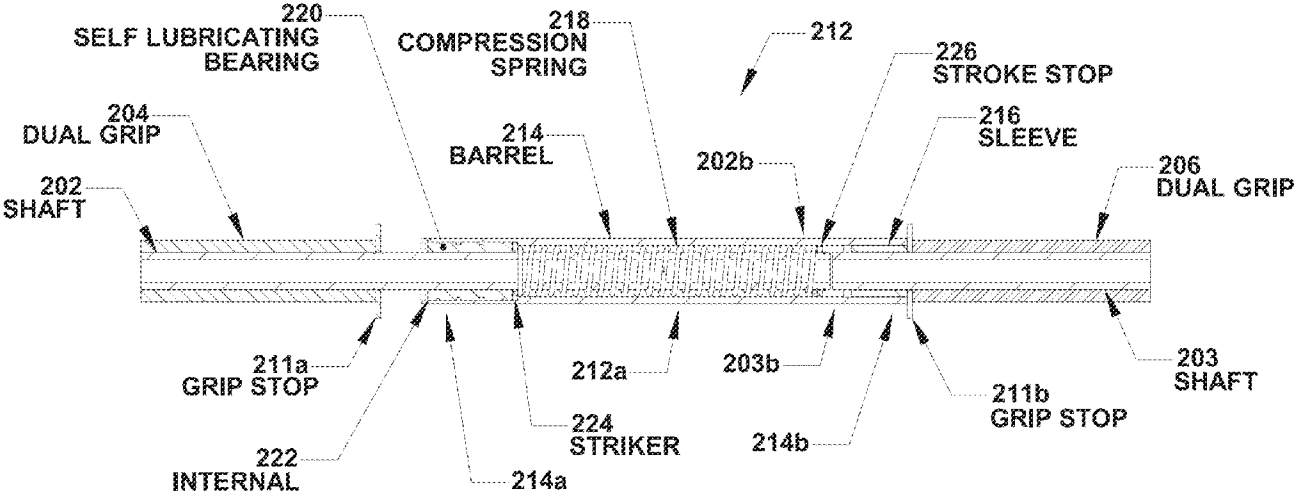
FIG. 5 is a cross-sectional view of the barbell of FIG. 4 taken along line B-B.
Figure 6:
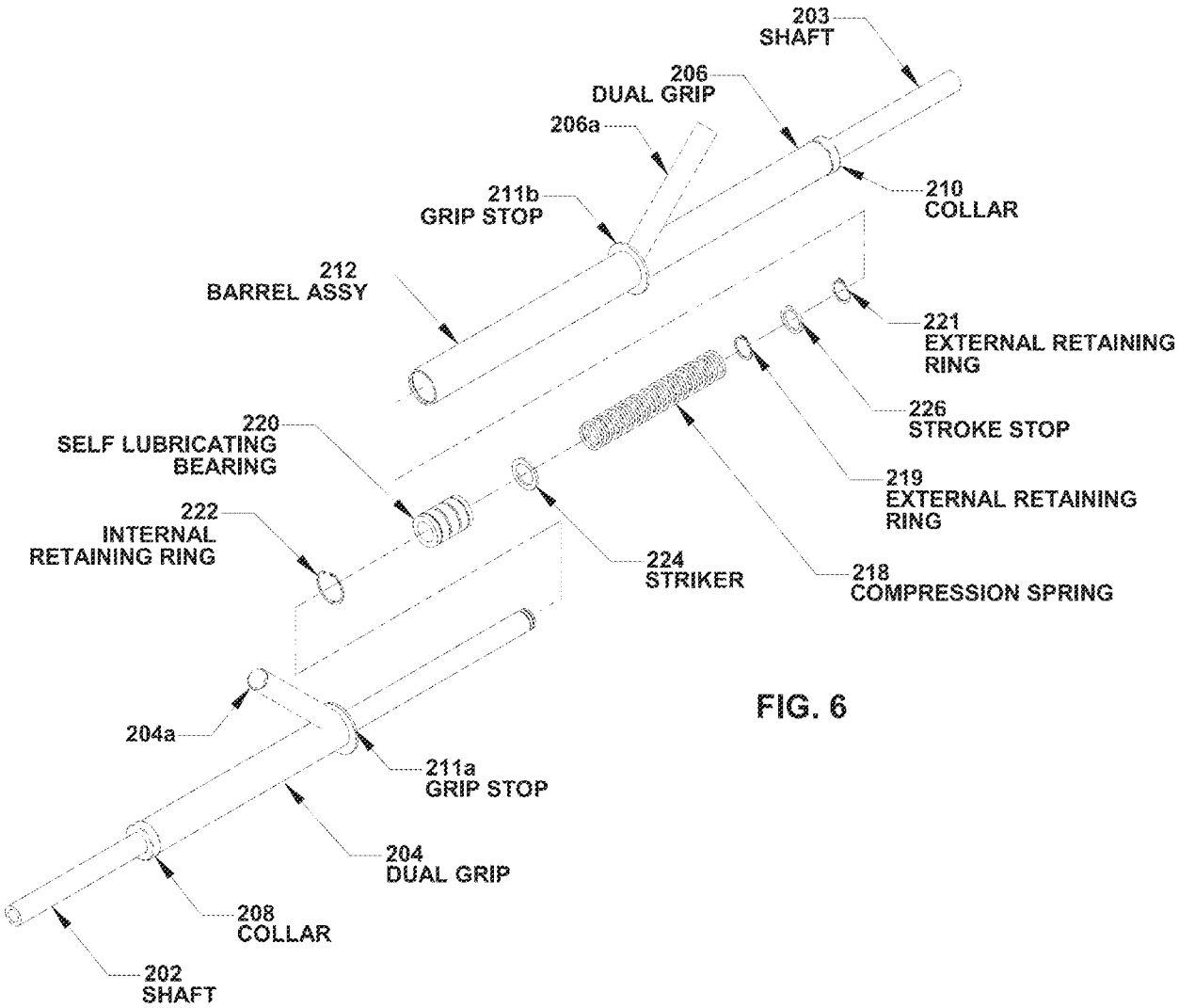
FIG. 6 is an exploded view of the barbell of FIG. 4.

FIG. 4 is an illustration of an exercise device, according to one embodiment. FIG. 5 is a cross-sectional view of the exercise device of FIG. 4 taken along line B-B. FIG. 6 is an exploded view of the exercise device of FIG. 4. The following discussion refers interchangeably to FIGS. 4-6.

The barbell 200 may utilize a spring action to provide resistance so a user can extend the barbell outward during an exercise resulting in more back and deltoid stimulation for the user than the tradition barbell. As shown, the exercise device or barbell 200 may include a first elongated cylindrical tubular shaft 202, having a first end 202*a* and a second end 202*b*, and an opposing second elongated cylindrical tubular shaft 203 having a first end 203*a* and a second end 203*b*. Tubular shaft ends 202*b* and 203*b* are located in a barrel assembly, described in more detail below. A first grip member 204 and a second grip member 206 may be disposed on the first and second elongated cylindrical tubular shafts 202 and 203 respectively equidistant from the center region 212*a* of the barbell. According to one example as shown, the first and second grip members 204, 206 may be dual grip members having an optional angled portion 204*a* and 206*a*, respectively, extending outwardly providing the user with different options in which to place his hands while grasping the barbell.

The first ends 202*a*, 203*a* of the first and second elongated tubular shafts 202 and 203 are adapted to receive weight plates (not shown) of varying weight. The weights may be held in place and secured to the first elongated tubular cylindrical shaft 202 by a first collar 208 and a second collar 210 on the second elongated tubular cylindrical shaft 203, respectively. The first and second grip members 204, 206 may be adapted for receiving hands of a user allowing the user to lift the exercise device or barbell 200 for exercising, including but not limited to weight training, weightlifting and powerlifting. According to one example, a user may utilize the barbell 200 without any weight plates secured thereon.

The barbell 200 may further include a barrel assembly 212 slideably mounted on the first and second elongated tubular cylindrical shafts 202 and 203 located between the first and second grip members 204, 206. The barrel assembly 212 may be adapted to compress and expand the first elongated tubular cylindrical shaft 202 varying resistance applied to the targeted muscle group. Varying the resistance enables the user to instantaneously force the exercise device outward following a standard movement. Collectively, these additional movements provide constant tension to a targeted muscle group.

According to one embodiment, the barrel assembly 212 may comprise a tubular housing 214 having a first housing end 214*a* and a second housing end 214*b* and a hollow tubular sleeve 216 axially mounted on the second elongated cylindrical shaft end 203*b*. (See FIG. 5) An elongated compression spring 218 may be longitudinally located in the hollow chamber of the tubular housing 214 and adapted to be compressed and expanded along a determined direction varying the tension and resistance. A self-lubricating bearing 220, which is a hollow cylindrical body with an axial hole in its center, and a striker 224 may be located in a bored hole in the barrel and retained by an internal retaining ring 222 and the first housing end 214*a* of the tubular housing 214 for maintaining the first elongated cylindrical shaft 202 in place and reducing binding.

The barrel assembly 212 may further comprise of a single stroke stop 226 installed at the end 202*b* of the tubular shaft 202 and located at the end of the compression spring 218 when mechanically assembled. That is, the compression spring 112 is located before the single stroke stop 126.

The barrel assembly 212 may be connected to a grip stop 211*b* of the second grip member 206. The barrel assembly 212 may be moveable between an expanded position and a compressed position. A user may exert an outward force on both grip members 206 and 204 utilizing standard (i.e. horizontal portions) or secondary (i.e. the angled portions) 204*a* and 206*a* grip positions simultaneously to compress the compression spring 218 creating tension. Conversely, a user may use both grip members 204 and 206 simultaneously to resist the expansion of the compression spring 218.

One or more of the components and functions illustrated in FIGS. 1-6 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. An exercise device, comprising:

a first elongated cylindrical tubular shaft having a first end and a second end;

a second elongated cylindrical tubular shaft having a first end and a second end;

a first grip member fixedly attached to the first elongated cylindrical tubular shaft; and a barrel assembly slideably mounted on the second end of the first elongated cylindrical tubular shaft at the second end of the second elongated cylindrical tubular shaft, the barrel assembly comprising:

an elongated tubular housing having a first housing end and a second housing end;

a hollow tubular sleeve mounted on the elongated tubular housing on the second housing end;

a single stroke stop installed at the second end of the first elongated cylindrical tubular shaft; and an elongated compression spring longitudinally disposed about the elongated tubular housing after the single stroke stop and adapted to be compressed and expanded along a determined direction;

wherein the barrel assembly further comprises a striker located in an axial hole in the barrel assembly and retained by a self-lubricating linear bearing at the first housing end of the elongated tubular housing; and a second grip member fixedly attached to the second elongated cylindrical tubular shaft, the first and second grip members disposed equidistant from a center region of the exercise device when the exercise device is in an uncompressed position.

2. The exercise device of claim 1, wherein the self-lubricating linear bearing is disposed in the first housing end and is retained by an internal retaining ring for maintaining the first elongated cylindrical shaft in place and reducing binding.

3. The exercise device of claim 2, wherein the self-lubricating bearing includes a hollow cylindrical body having an axial hole in its center.

4. The exercise device of claim 1, wherein the first grip member is a dual grip member having a horizontal portion and an angled portion extending upwardly from the horizontal portion.

5. The exercise device of claim 1, wherein the second grip member is a dual grip member having a horizontal portion and an angled portion extending upwardly from the horizontal portion.

6. The exercise device of claim 1, wherein the first and second elongated cylindrical tubular shafts are made of hardened steel.

7. The exercise device of claim 1, wherein decreasing a distance between the first and second grip members compresses the spring creating a resistance providing more pectoral and bicep stimulation of a user.

8. The exercise device of claim 1, wherein the exercise device is a barbell.

9. An exercise device, comprising:

a first elongated cylindrical tubular shaft having a first end and a second end;

a second elongated cylindrical tubular shaft having a first end and a second end;

a first grip member fixedly attached to the first elongated cylindrical tubular shaft; and a barrel assembly slideably mounted on the second end of the first elongated cylindrical tubular shaft at the second end of the second elongated cylindrical tubular shaft, the barrel assembly comprising:

an elongated tubular housing having a first housing end and a second housing end;

a hollow tubular sleeve mounted on the elongated tubular housing on the second housing end;

an elongated compression spring longitudinally disposed about the elongated tubular housing and adapted to be compressed and expanded along a determined direction; and a single stroke stop installed at the second end of the first elongated cylindrical tubular shaft after the elongated compression spring;

wherein the barrel assembly further comprises a striker located in an axial hole in the barrel assembly and retained by a self-lubricating linear bearing at the first housing end of the elongated tubular housing; and a second grip member fixedly attached to the second elongated cylindrical tubular shaft, the first and second grip members disposed equidistant from a center region of the exercise device when the exercise device is in an unexpanded position.

10. The exercise device of claim 9, wherein the self-lubricating linear bearing is disposed in the first housing end and is retained by an internal retaining ring for maintaining the first elongated cylindrical shaft in place and reducing binding.

11. The exercise device of claim 10, wherein the self-lubricating bearing includes a hollow cylindrical body having an axial hole in its center.

12. The exercise device of claim 9, wherein the first grip member is a dual grip member having a horizontal portion and an angled portion extending upwardly from the horizontal portion.

13. The exercise device of claim 9, wherein the second grip member is a dual grip member having a horizontal portion and an angled portion extending upwardly from the horizontal portion.

14. The exercise device of claim 9, wherein the first and second elongated cylindrical tubular shafts are made of hardened steel.

15. The exercise device of claim 9, wherein increasing distance between the first and second grip members compresses the spring creating a resistance providing more back and deltoid stimulation of a user.

16. The exercise device of claim 9, wherein the exercise device is a barbell.

* * * * *